United States Patent [19]

Schwartz

[11] 4,338,734

[45] Jul. 13, 1982

[54] UNIVERSAL ORTHOTIC

[75] Inventor: Richard B. Schwartz, Woodcliff Lake, N.J.

[73] Assignee: Apex Foot Products Corp., Englewood, N.J.

[21] Appl. No.: 123,850

[22] Filed: Feb. 22, 1980

[51] Int. Cl.[3] ..... A43B 13/38; A43B 23/08

[52] U.S. Cl. ..... 36/44; 36/69

[58] Field of Search ..... 36/43, 44, 69, 92

[56] References Cited

U.S. PATENT DOCUMENTS

| | | | |
|---|---|---|---|
| 3,333,353 | 8/1967 | Garcia | 36/69 |
| 3,412,487 | 11/1968 | Diamant | 36/44 |
| 3,561,141 | 2/1971 | Brown | 36/44 |
| 4,137,654 | 2/1979 | Hlavac | 36/69 |

*Primary Examiner*—Patrick D. Lawson

*Attorney, Agent, or Firm*—Lerner, David, Littenberg & Samuel

[57] ABSTRACT

A shell for an orthotic is formed monolithically and includes a heel post, a navicular flange and a metatarsal raise. The shell can be made from a semi-rigid material, such as molded rubber, and encapsulated by a suitable covering so as to form a universal orthotic.

14 Claims, 2 Drawing Figures

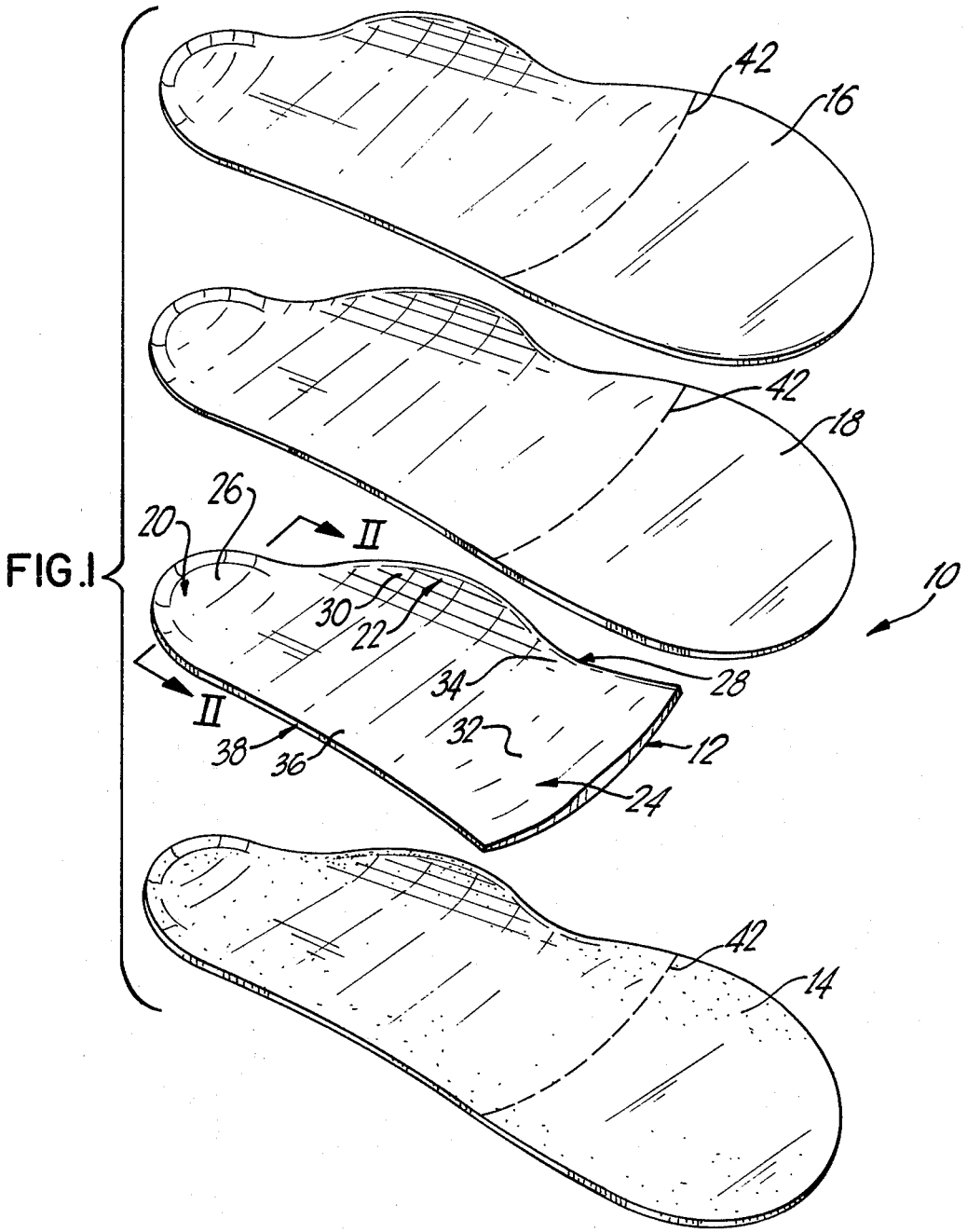
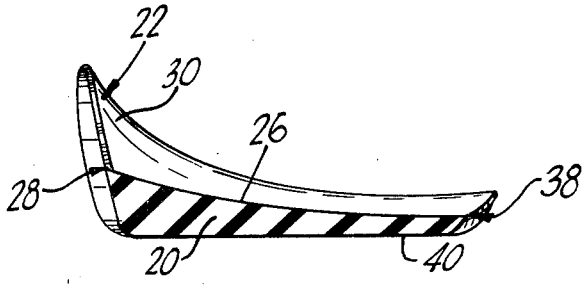
FIG.2

UNIVERSAL ORTHOTIC

FIELD OF THE INVENTION

The present invention relates to orthotics, i.e., orthopedic appliances, and, more particularly, to orthotics which are especially adapted for insertion into a sports shoe, such as a sneaker.

BACKGROUND OF THE INVENTION

In the past, orthopedic appliances have been developed to relieve common biomechanical foot disorders of athletes, for example, basketball players, runners and skiers. These orthopedic appliances have employed a variety of different types of orthotics.

One type of prior art orthotic utilizes a composite shell made from a rigid material. Because the shell is formed from a plurality of separate pieces, which must be attached to each other by bonding or otherwise, manufacturing time and costs are increased. The rigidity of the shell is disadvantageous, inasmuch as the shell does not readily conform to feet having various different shapes, thereby requiring that the shell be custom made for each individual user. Due to its rigidity, the shell also inhibits shock absorption, as well as plantar flexion (a flexing of the foot which occurs when the heel is in contact with the ground and the rest of the foot is elevated off of the ground) and dorsiflexion (a flexing of the foot which occurs when the toes are in contact with the ground and the rest of the foot is elevated off of the ground), thereby impairing the effectiveness of the shell.

Completely flexible orthotics are also known. These flexible orthotics are disadvantageous, because they provide little or no support for the foot.

SUMMARY OF THE INVENTION

Many of the problems and disadvantages of the prior art orthotics discussed above are overcome by providing a new and improved orthotic shell. In accordance with the improvement, the shell, which may include a heel post, a navicular flange and a metatarsal raise, is formed monolithically, thereby facilitating its manufacture.

The monolithic shell can be formed from a semi-rigid material, such as molded rubber, having a flexibility sufficient to permit complete plantar flexion and dorsiflexion of a foot supported by the shell and a softness and density sufficient to permit the shell to absorb shocks, thereby facilitating the relief of foot stress and heel pain. By selecting the softness of the semi-rigid material so that the shell conforms to feet having various different shapes, the shell can be used to manufacture a universal orthotic, i.e., an orthotic which can be used by a number of individuals without requiring custom fitting or manufacturing. Absorption of pressure and relief of foot stress can be further facilitated if the shell is covered with an appropriate sponge material, such as a closed-cell polyethylene foam.

The heel post should have an angle in a range of from about 3° to about 10°, preferably about 8°. Such an angle is helpful in setting a proper gait for the foot, i.e., urging the foot into a neutral position in which it does not list to either its medial (inner) or lateral (outer) side, while maintaining proper support of the heel, arch, and ball of the foot, thereby facilitating the proper orientation and support of the foot for running. Maintaining the proper orientation and support of the foot facilitates balance, shock absorption, hindfoot control and stability and inhibits twisting, stress fractures, tendonitis and blisters.

BRIEF DESCRIPTION OF THE DRAWINGS

For a more complete understanding of the present invention, reference may be had to the following description of an exemplary embodiment taken in conjunction with the accompanying figures of the drawing, in which:

FIG. 1 is an exploded perspective view of an orthotic constructed in accordance with the present invention; and FIG. 2 is a cross-sectional view, taken along line II—II of FIG. 1 and looking in the direction of the arrows, of a shell which forms a part of the orthotic shown in FIG. 1.

DESCRIPTION OF AN EXEMPLARY EMBODIMENT

With reference to FIGS. 1 and 2, there is shown an orthotic 10 for a sports shoe. The orthotic 10 includes a monolithic shell 12, a bottom covering 14 bonded to the shell 12, a top covering 16 and an intermediate layer 18 disposed between and bonded to the shell 12 and the top covering 16.

The shell 12 has a heel post 20, a navicular flange 22 and a metatarsal raise 24. The heel post 20, navicular flange 22 and metatarsal raise 24 properly position the navicular, cuboid and sesamoid bones when the calcaneus bone is in a neutral position, so that from heel to metatarsals the foot is in proper alignment, thereby facilitating uniform balance and distribution of weight over the entire foot without producing undue stress on any part thereof.

The heel post 20 is provided with a shallow cup-shaped upper surface 26 adapted to receive the heel of the foot. The heel post 20 is generally wedge-shaped, in transverse cross section, and has an angle of about 8° (see FIG. 2), although the angle could be in a range of from about 3° to about 10°. Inasmuch as the shell 12 is preferably made from a compressible semi-rigid material, the angle should be selected so that it is greater than a prescribed angle, chosen so as to set the foot at its proper gait, by an amount which will permit the heel post 20 to assume the prescribed angle upon compression by the foot. Inasmuch as the thickest portion of the heel post 20 is located on a medial or inner side 28 of the shell 12, the heel post 20 urges the foot outwardly into its proper gait, i.e., a position in which the foot does not list to either its medial (inner) or lateral (outer) side.

The cup-shaped upper surface 26 of the heel post 20 flows directly into an inclined upper surface 30 of the navicular flange 22. The shape and position of the navicular flange 22 generally match the shape and position, respectively, of an arch of an average foot. However, the navicular flange 22 should be high enough so that it, due to the compressibility of the semi-rigid material forming the shell 12, can conform to a foot having a low, medium or high arch, thereby increasing the universalness of the orthotic 10. If the navicular flange 22 were low, it could not conform to a foot having a medium or high arch and, therefore, would be limited to effective use in connection with a foot having a low arch.

The metatarsal raise 24 has an upper surface 32 which flows directly into the upper surface 30 of the navicular flange 22. The metatarsal raise 24 has a gradual slope.

However, if necessary, additional metatarsal padding can be provided.

The shell 12 can also be provided with a medial sesamoid support 34. It is also possible to provide a cuboid support 36 along a lateral side 38 of the shell 12.

The bottom covering 14 completely covers a bottom surface 40 of the shell 12 and extends beyond the periphery thereof. The portion of the bottom covering 14 underlying the bottom surface 36 of the shell 12 has a shape which generally matches the shape of the bottom surface 36 of the shell 12.

The upper surfaces 26, 30, 32 of the heel post 20, navicular flange 22 and metatarsal raise 24, respectively, are covered completely by the top covering 16 and the intermediate layer 18. The top covering 16 and the intermediate layer 18 extend outwardly beyond the periphery of the upper surfaces 26, 30, 32 of the heel post 20, navicular flange 22 and metatarsal raise 24, respectively. The outwardly extending portion of the intermediate layer 18 is bonded to the outwardly extending portion of the bottom covering 14 to encapsulate the shell 12. The portions of the top covering 16 and the intermediate layer 18 overlying the shell 12 have shapes which generally match the shapes of the upper surfaces 26, 30, 32 of the heel post 20, navicular flange 22 and metatarsal raise 24, respectively.

The bottom covering 14, the top covering 16 and the intermediate layer 18 preferably have a heel-to-toe length, which helps to properly position the orthotic 10 in the sports shoe. Alternatively, the bottom covering 14, the top covering 16 and the intermediate layer 18 could be cut along an imaginary line, represented by dotted lines 42, so that the orthotic 10 has a three-quarter or heel-to-ball length.

Any suitable semi-rigid material, such as a molded rubber, may be used to make the shell 12, as long as the material has a sufficient flexibility so as to permit complete plantar flexion and dorsiflexion of a foot supported by the orthotic 10 and a softness and density sufficient to permit the orthotic 10 to absorb shocks. The softness of the semi-rigid material should also be selected so that the shell 12 conforms to feet having various different shapes. By making the shell 12 from a semi-rigid material having an elastic memory, the compression of the shell 12 will not result in its permanent deformation, thereby increasing the effective operating life of the shell 12. The bottom covering 14 can be made from any suitable material, such as seudine, which prevents the orthotic 10 from sliding in the sports shoe. A polyethylene foam is preferably employed as the intermediate layer 18, so that the intermediate layer 18 can conform to the shape of the foot, while maintaining its cushioning and/or shock absorbing capabilities. The top covering 16 is made from stretchable nylon, which stretches in all directions so as to reduce friction between the orthotic 10 and the foot, thereby inhibiting the formation of blisters.

It should be understood that the embodiment described herein is merely exemplary and that a person skilled in the art may make many variations and modifications without departing from the spirit and scope of the invention. All such modifications and variations are intended to be included within the scope of the invention as defined in the appended claims.

I claim:

1. A universal orthotic, comprising a monolithic shell having a heel-to-ball length and being made from a semi-rigid material, said shell including a medial heel post, having an angle in a range of from about 3° to about 10°, a lower surface and an upper surface, a navicular flange, having a lower surface and an upper surface which flows directly into said upper surface of said heel post, and a matatarsal raise, having a lower surface and an upper surface which flows directly into said upper surface of said navicular flange; first covering means for covering said upper surfaces of said heel post, navicular flange and metatarsal raise; and second covering means for covering said lower surfaces of said heel post, navicular flange and metatarsal raise.

2. A universal orthotic according to claim 1, wherein each of said first and second covering means has a generally heel-to-ball length.

3. A universal orthotic, comprising a monolithic shell made from a semi-rigid material and including a medial heel post, having an angle in a range of from about 3° to about 10°, a lower surface and an upper surface, a navicular flange, having a lower surface and an upper surface which flows directly into said upper surface of said heel post, and a metatarsal raise, having a lower surface and an upper surface which flows directly into said upper surface of said navicular flange; first covering means for covering said upper surfaces of said heel post, navicular flange and metatarsal raise, said first covering means including a layer of polyethylene foam, having a pair of opposite surfaces, one of said pair of opposite surfaces being attached directly to said upper surfaces of said heel post, navicular flange and metatarsal raise, and a layer of stretchable nylon directly attached to the other of said pair of opposite surfaces of said layer of polyethylene foam; and second covering means for covering said lower surfaces of said heel post, navicular flange and metatarsal raise.

4. A universal orthotic according to claim 3, wherein said second covering means includes a layer of seudine.

5. A universal orthotic according to claim 3, wherein said shell has a generally heel-to-ball length and each of said first and second covering means has a generally heel-to-ball length.

6. A universal orthotic according to claim 1 or 3, wherein said semi-rigid material is molded rubber.

7. A universal orthotic according to claim 1 or 3, wherein said semi-rigid material has a flexibility sufficient to permit complete plantar flexion and dorsiflexion of a foot supported by said orthotic.

8. A universal orthotic according to claim 1 or 3, wherein said semi-rigid material has a softness and density sufficient to permit said orthotic to absorb shocks.

9. A universal orthotic according to claim 1 or 3, wherein said semi-rigid material has a softness sufficient to permit said shell to readily conform to feet having various different shapes.

10. A universal according to claim 1 or 3, wherein said semi-rigid material has an elastic memory.

11. A universal orthotic according to claim 1 or 3, wherein said angle of said heel post is about 8°.

12. A universal orthotic according to claim 1 or 3, wherein said first and second covering means extend outwardly beyond said upper and lower surfaces, respectively, of said heel post, navicular flange and metatarsal raise, the outwardly extending portions of said first and second covering means being attached to each other so as to encapsulate said shell.

13. A universal orthotic according to claim 1 or 3, wherein said shell has a generally heel-to-ball length and each of said first and second covering means has a generally heel-to-toe length.

14. A universal orthotic according to claim 1 or 3, wherein said navicular flange has at least a medium height.

* * * * *

UNITED STATES PATENT AND TRADEMARK OFFICE

CERTIFICATE OF CORRECTION

PATENT NO. : 4,338,734

DATED : July 13, 1982

INVENTOR(S) : Richard B. Schwartz

It is certified that error appears in the above-identified patent and that said Letters Patent are hereby corrected as shown below:

Column 4, line 50, after "universal" insert --orthotic--.

Signed and Sealed this

*Fourteenth* Day of *September 1982*

[SEAL]

*Attest:*

GERALD J. MOSSINGHOFF

*Attesting Officer*

*Commissioner of Patents and Trademarks*